US008622741B2

(12) United States Patent
Wilen

(10) Patent No.: US 8,622,741 B2
(45) Date of Patent: Jan. 7, 2014

(54) FORM-BASED ARTWORK KITS

(75) Inventor: Richard Wilen, Deerfield Beach, FL (US)

(73) Assignee: WILopEN Products, LC, Deerfield Beach, FL (US)

( * ) Notice: Subject to any disclaimer, the term of this patent is extended or adjusted under 35 U.S.C. 154(b) by 365 days.

(21) Appl. No.: 12/846,835

(22) Filed: Jul. 30, 2010

(65) Prior Publication Data

US 2012/0027965 A1 Feb. 2, 2012

(51) Int. Cl.
*G09B 25/00* (2006.01)

(52) U.S. Cl.
USPC ..... 434/80

(58) Field of Classification Search
USPC ..... 434/81
See application file for complete search history.

(56) References Cited

U.S. PATENT DOCUMENTS 3,768,177 A * 10/1973 Thomas ..... 434/81
3,840,113 A * 10/1974 Bartleson ..... 206/575
4,514,175 A * 4/1985 Zaruba et al. ..... 434/82
4,836,381 A * 6/1989 Edwards et al. ..... 206/575
4,836,783 A * 6/1989 Harper ..... 434/87
5,106,305 A * 4/1992 Grant ..... 434/84
5,110,295 A * 5/1992 Concra ..... 434/88
5,141,438 A * 8/1992 Spector ..... 434/87
5,284,445 A * 2/1994 Dietterich et al. ..... 434/419
5,292,154 A 3/1994 Williams
5,427,528 A * 6/1995 Anderson et al. ..... 434/83
5,562,451 A * 10/1996 Wilcox et al. ..... 434/84
5,695,346 A * 12/1997 Sekiguchi et al. ..... 434/365
5,788,501 A * 8/1998 Hassall ..... 434/84
5,988,687 A 11/1999 Krisch
6,213,778 B1 * 4/2001 Cohen ..... 434/84
6,241,528 B1 * 6/2001 Myers ..... 434/408
6,883,985 B2 * 4/2005 Roberson ..... 400/490
6,896,520 B2 * 5/2005 Swartz ..... 434/81
7,056,121 B2 * 6/2006 Koeppel ..... 434/84
7,182,667 B2 * 2/2007 Wittmeyer, Jr. ..... 446/147
7,384,669 B2 6/2008 Veck
2004/0228989 A1 11/2004 Abramek
2007/0057458 A1 3/2007 Haag
2009/0258773 A1 10/2009 Shine

FOREIGN PATENT DOCUMENTS

GB 2423958 9/2006

OTHER PUBLICATIONS http://www.google.com/?tbm=pts&hl=en.*

* cited by examiner

*Primary Examiner* — Kurt Fernstrom
*Assistant Examiner* — Dolores Collins
(74) *Attorney, Agent, or Firm* — Johnson & Martin, P.A.; James David Johnson

(57) ABSTRACT

A printable multi-purpose form is described that features detachable pieces, which may be separated and attached to a substrate to create an artwork. The detachable pieces can be connected together using separator pieces and adhesive to form stacked images for the creation of three-dimensional artworks.

24 Claims, 5 Drawing Sheets

FORM-BASED ARTWORK KITS

FIELD OF THE INVENTION

The invention relates to art kits. More particularly, the invention relates to artwork kits containing forms having detachable components that can be customized by printing thereon using computer software and a printer to create user-customized works of art.

BACKGROUND

Forms featuring detachable components such as labels or business cards have been available for purchase by consumers. Likewise, art kits that include pre-printed scenes, paint, paint brushes, and instructions, such as paint-by-number kits, are available for purchase by consumers. Printing and imprinting on the customizable spaces of conventional printable forms may be accomplished using a home or office desktop printer. Printable and imprintable forms have not previously been combined with other materials and components to create artwork kits that involve the user and that permit the user to make customizations simultaneously with the creation of a work of art.

SUMMARY

An artwork kit is provided that includes one sheet or a plurality of sheets of material that may be printed or imprinted upon using a printing device. The artwork kit can also include a substrate. Each sheet can include a single sheet or a plurality of sheets, each of which can include one or more detachable components. After printing or imprinting, the detachable components may be separated and attached to a substrate to create an artwork.

The sheet can be manufactured from paper, paperboard, metallic foil, semi-metallic foil, or plastic. Each sheet can include a frame formed from the paper or other material of the sheet. The frame can be formed around the side edges of each detachable component, or the sheet may be constructed so that the frame is formed only around the outside edges of each sheet. The detachable components can be sized, shaped, and arranged on the sheet so as to maximize the usage of paper included in each sheet and to reduce waste by ensuring that the frame forms only a minimally necessary portion of the sheet. Each sheet may also include no frame at all but only detachable components connected to one another.

The detachable components may be torn, punched out, or otherwise detached from the sheet along lines of separation. The lines of separation can be perforations that assist the user in cleanly removing each detachable component from the sheet without creating rips in the detachable component or leaving hanging paper fragments that result when two detachable components are separated along a line of separation (e.g., a fold line) that does not include perforations. Microperforations can also be used to provide the cleanest separation so that the edges of the separated detachable components appear smooth.

The sheet can be a printable form and can include preprinted graphics and text or it may be supplied to the user totally blank. Software that can be installed on the user's computer or accessed remotely on a website via the Internet can be used to customize and print or imprint customizations on the printable form.

The printable form can include one, two, three, four, five, or more sheets, each sheet featuring one or more detachable pieces that can be configured to form an artwork. The detachable pieces may be formed into regular or irregular shapes and can be separable from each sheet along lines of separation. The lines of separation can be fold lines that may be cut or torn apart by a user or perforations that may be torn or punched out by the user to separate the detachable pieces from each other and from a frame in embodiments where the sheet includes a frame. The sheets can include preprinted text or images, or the sheets can be entirely blank or can include blank customizable spaces. The user may print, draw, or emboss images or text onto the customizable spaces or affix labels or stamps on or over the customizable spaces.

The sheets may be supplied as part of a kit that also includes a plurality of separator pieces and a substrate. The substrate can be more rigid than the printable forms. The user may print the same image, symbol, or text on two, but preferably three or more, sheets. The sheets customized in this manner will include sets of detachable pieces identical in shape and size. Each set of identical detachable pieces may be separated from their respective sheets and attached together using the separator pieces and an adhesive. When connected, each image printed on each identical detachable piece can be viewed, in large part, even though the identical detachable pieces are attached together using the separator pieces in a stacked configuration. The same image, symbol, or text can be printed on an additional sheet that can be attached to a front surface of the substrate to form a base sheet. The base sheet can be attached to the substrate as a single unitary sheet, or its detachable pieces may be separated and attached individually to the substrate in an arrangement or orientation decided by the user. Using a separator piece, the connected, stacked identical detachable pieces can be secured above corresponding identical images, symbols, or text on the base sheet, thereby allowing the user to create a three-dimensional artwork composed of stacked images, symbols, or text.

In one embodiment, the detachable pieces can be connected together using separator pieces and adhesive to form stacked images. The stacked images can be connected to the substrate to create three-dimensional artworks.

In another embodiment, the substrate can include perforations or cuts that permit it to be disassembled into a plurality of regularly or irregularly shaped pieces that can be reassembled or reconnected to reform the original shape of the substrate. The sheet can include perforations or cuts so that its detachable components correspond in size and shape to the plurality of regularly or irregularly shaped pieces of the substrate. Once a photograph or other image has been printed or imprinted on the sheet, the sheet can be connected to the substrate by adhesive so that the lines of perforation of the substrate and of the sheet align, thereby creating a puzzle.

In another embodiment, the sheet can include a plurality of fold lines, perforations, or cuts that permit the sheet to be folded and assembled into a predetermined object such as, for example, into the shape of a toy car or a Christmas tree ornament. In this way, a user can print or imprint colors, photographs, or other images on the sheet to customize the appearance of the object before the sheet is folded and assembled to create the object.

The terms "print" and "printable" as used herein relate to printing on one of the multi-purpose forms during the manufacturing of the form, or printing on a surface of the form in a first instance by a manufacturer. The terms "imprint" and "imprintable" as used herein refer to printing on one of the forms by a user subsequent to manufacturing. Imprinting can be accomplished manually using a pen, pencil, or other hand-held writing instrument, or mechanically using a printer or printing device. For example, the user may imprint customizations onto a blank form in the first instance where the manufacturer has not printed any information on the form during manufacturing, or the user may imprint customizations in a second, third, fourth or other instance onto a form that includes information printed thereon by the manufacturer during manufacturing. By way of further example, a form that includes information printed thereon by the manufacturer during manufacturing is printed in the first instance, customizations subsequently printed onto the form by a user are imprinted in the second instance, and additional information thereafter printed onto the same form by the same user or by another user is imprinted in the third instance.

One advantage of the printable form is that users may create artwork or puzzles easily and quickly using the kit and a home or office desktop printer without the need for any specialized knowledge or skills.

Another advantage of the printable form is that users may create artwork in the form of objects or model shapes that imitate other real objects, e.g., an automobile, or a Christmas tree ornament, that include customizations selected by the user.

Accordingly, the invention can feature an artwork kit that includes at least one printable sheet having a plurality of detachable pieces and a substrate to which the detachable pieces are attachable to create an artwork. The detachable pieces can feature customizable spaces on which user customizations may be printed by a user prior to detaching the detachable pieces from the printable sheet.

In another aspect, the invention can feature the substrate including a rigid backing.

In another aspect, the invention can feature the detachable pieces including a front surface and a rear surface.

In another aspect, the invention can feature the rear surface of the detachable pieces including an adhesive.

In another aspect, the invention can feature the printable sheet including lines of separation from which the detachable pieces can be separated.

In another aspect, the invention can feature the lines of separation being perforations.

In another aspect, the invention can feature the customizations including at least one printed item selected from among: text, an image, and a symbol.

In another aspect, the invention can feature the printable sheet being capable of having customizations printed in the customizable spaces by the user using a printer to create a user-customized sheet.

In another aspect, the invention can feature the printable sheet including a front surface on which the customizable spaces are located and a rear surface including an adhesive and a non-stick backing mounted over the adhesive so as to be attached to and facing the rear surface.

In another aspect, the invention can feature the non-stick backing being wax paper.

In another aspect, the invention can feature the non-stick backing being removable so as to expose the adhesive on the rear surface of the printable sheet.

In another aspect, the invention can feature the printable sheet and the substrate each including matching lines of separation so that, when the adhesive of the rear surface is exposed, the printable sheet is attachable to the substrate in a manner so that the lines of separation of the printable sheet are aligned over and in parallel to the lines of separation of the substrate.

In another aspect, the invention can feature the artwork formed by the attachment of the printable sheet to the substrate being a jig-saw puzzle.

In another aspect, the invention can feature the substrate including a frame.

In another aspect, the invention can feature the artwork kit can include at least three printable sheets.

In another aspect, the invention can feature a single image being printed on each of the at least three printable sheets.

In another aspect, the invention can feature the artwork kit further including a plurality of separators, each separator having a top surface and a bottom surface.

In another aspect, the invention can feature the detachable pieces being separable from the at least three printable sheets and configurable so that each set of three corresponding detachable pieces including the same shape and image are attached together by affixing one of the plurality of separators to a rear surface of each corresponding detachable piece.

In another aspect, the invention can feature the detachable pieces being separable from the at least three printable sheets to form three-piece sets of each of the detachable pieces that are identical in shape and color, wherein the three-piece sets include a first set of detachable pieces, a second set of detachable pieces, and a third set of detachable pieces.

In another aspect, the invention can feature the top surface of an at least first separator of the plurality of separators being affixed to a rear surface of each of the first set of detachable pieces, the top surface of an at least second separator of the plurality of separators being affixed to a rear surface of each of the second set of detachable pieces, and the top surface of an at least third separator of the plurality of separators being affixed to a rear surface of each of the third set of detachable pieces.

In another aspect, the invention can feature the bottom surface of the at least first separator of the plurality of separators being affixed to a front surface of each of the second set of detachable pieces so as to interconnect between the rear surface of each of the first set of detachable pieces and the front surface of each of the second set of detachable pieces, the bottom surface of the at least second separator of the plurality of separators being affixed to a front surface of each of the third set of detachable pieces so as to interconnect between the rear surface of each of the second set of detachable pieces and the front surface of each of the third set of detachable pieces, and the bottom surface of the at least third separator of the plurality of separators being affixed to a front surface of the substrate so as to interconnect between the rear surface of each of the third set of detachable pieces and the front surface of the substrate.

In another aspect, the invention can feature the artwork formed by the attachment of the first, second, and third sets of detachable pieces to the substrate being a three-dimensional artwork.

In another aspect, the invention can feature the substrate including a frame.

In another aspect, the invention can feature software for installation on a computer to enable the user to customize customizable spaces on the at least one printable sheet with user customizations.

In another aspect, the invention can feature a website that can be accessed via a communications network. The website can include software that permits the user to customize the customizable spaces of at least one printable form with user customizations.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
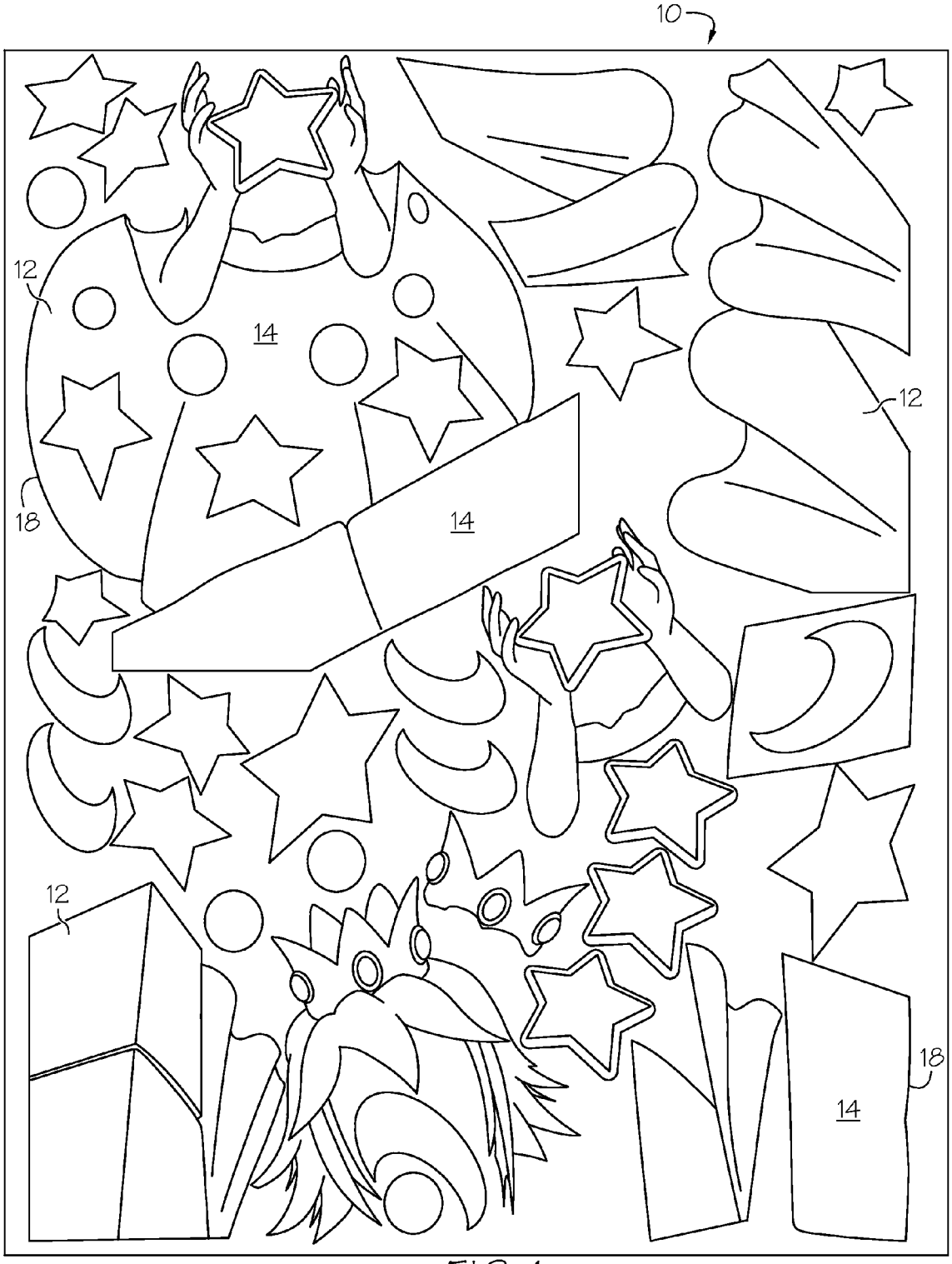
FIG. 1 is a front view of a printable form of the artwork kit featuring detachable pieces that can be configured to form a three-dimensional artwork.
Figure 2:
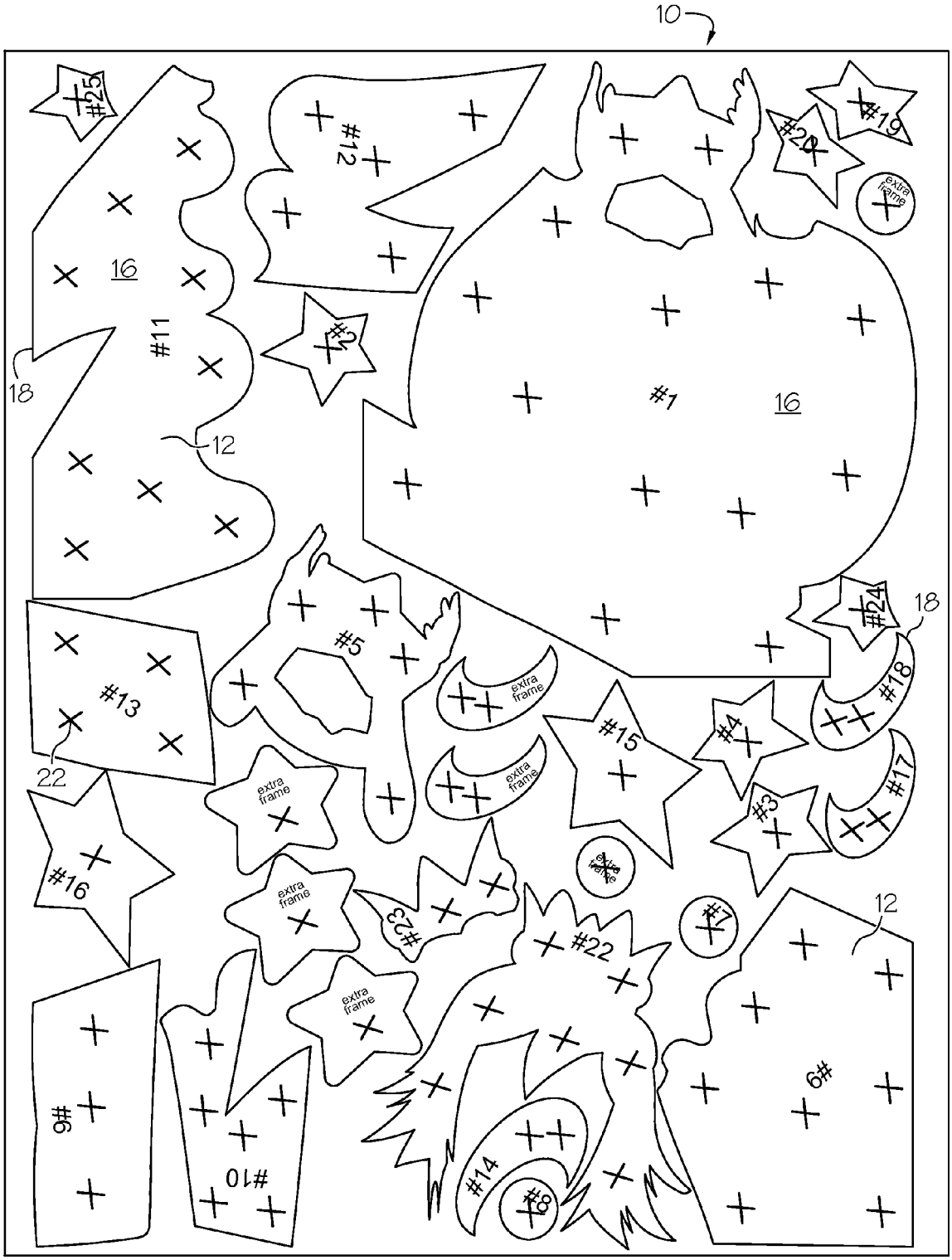
FIG. 2 is a rear view of the printable form of the artwork kit of FIG. 1.

The invention relates to an artwork kit 10 as shown in FIGS. 1-5. The artwork kit 10 can include one or more printable sheets 30, each having one or more detachable pieces 12. The detachable pieces 12 can include one or more customizable spaces on which a user can print user customizations. The customizations can be printed on the detachable pieces 12 before their detachment from the printable sheet. The artwork kit 10 can also feature a substrate to which the detachable pieces 12 can be attached for creating an artwork 40. The artwork kit 10 will contain all of the components necessary for the user to create the artwork 40.

The substrate 32 can feature a rigid backing such as, for example, paperboard, cardboard, particle board, wood, canvas, stone, plastic, rubber, elastomeric materials, composite and other artificial materials, and any other suitably rigid materials to which the detachable pieces 12 can be attached.

The detachable pieces 12 include a front surface 14 and a rear surface 16. The rear surface 16 of the detachable pieces 12 can feature an adhesive that may be used to connect the detachable pieces to the substrate 32 or to one another. The detachable pieces 12 can be detached from the printable sheet 30 by tearing, ripping, or cutting along lines of separation 18 between each detachable piece or between each detachable piece and a frame. The lines of separation 18 can be fold lines, score lines, or printed dashed or dotted lines. In an exemplary embodiment, the lines of separation 18 can be perforations. In a most exemplary embodiment, the lines of separation 18 can be microperforations.

The detachable pieces 12 can be die cut into individual pieces using any cutting device and can be detached before packaging the kit 10. In another embodiment, the detachable pieces 12 can be left attached and in sheet form with the pieces and sheet 30 held together by a plurality of small ticks, cuts, or perforations around the die cut detachable pieces. In another embodiment, the sheet 30 and its detachable pieces 12 can be adhered to a backing for the purpose of holding the individual pieces together.

The printable sheets 30 of the artwork kit 10 can be manufactured from any material that can be fed through a printer and which has a surface on which the printer may print. Suitable materials can include paper, plastic, metallic or semi-metallic foil, and paperboard. The material can be of any weight, thickness, or stiffness or rigidity as long as the material is sufficiently flexible to be moved mechanically through the printer, and as long as the ink includes the proper chemical composition to ensure its adhesion to the surface of the material. The material can also be any size or shape that can be received by and fed through the printer. In exemplary embodiments, the material can be 8.5 inches by 11 inches (letter size), 8.5 inches by 14 inches (legal size), 11 inches by 17 inches, or A4.

The printer used with this invention can be a home or office desktop printer or a larger stand-alone multifunction printer such as the types commonly found in offices. Because the printable sheet is contemplated to be commonly used by consumers at home, the printable sheet and software used therewith may be optimized for use with home desktop printers. The printer may be of a type capable of printing on only a single side of a sheet or on both sides of the printable sheet.

Each printable sheet 30 of the artwork kit 10 features a first surface, a second surface, a top edge, a bottom edge, and two side edges. The first surface can be a front surface 14 and the second surface can be a rear surface 16, or vice versa. Each printable sheet 30 can feature pre-printed graphics 36 printed on the first surface, on the second surface, or on both. The pre-printed graphics 36 can also be printed on the detachable pieces 12, which form part of the first and second surfaces of the printable sheet 30. In an exemplary embodiment, the detachable pieces 12 can include customizable spaces on which a user may print or affix the user's own customizations 34. Such customizations 34 can include at least one printed, written, drawn, embossed, or affixed item such as, for example, text, an image, a symbol, a label, and a stamp. The customizations 34 can be selected using software that can be provided with or separate from the artwork kit 10 and installed on a computer or using software that is accessible via a website available on the Internet or another communications network. The user may select from among stock customizations provided by the software manufacturer or website operator, or the user may choose to use custom content provided by the user to create the customizations that can be printed on the customizable spaces of the printable sheet using a printer.

Figure 3A:
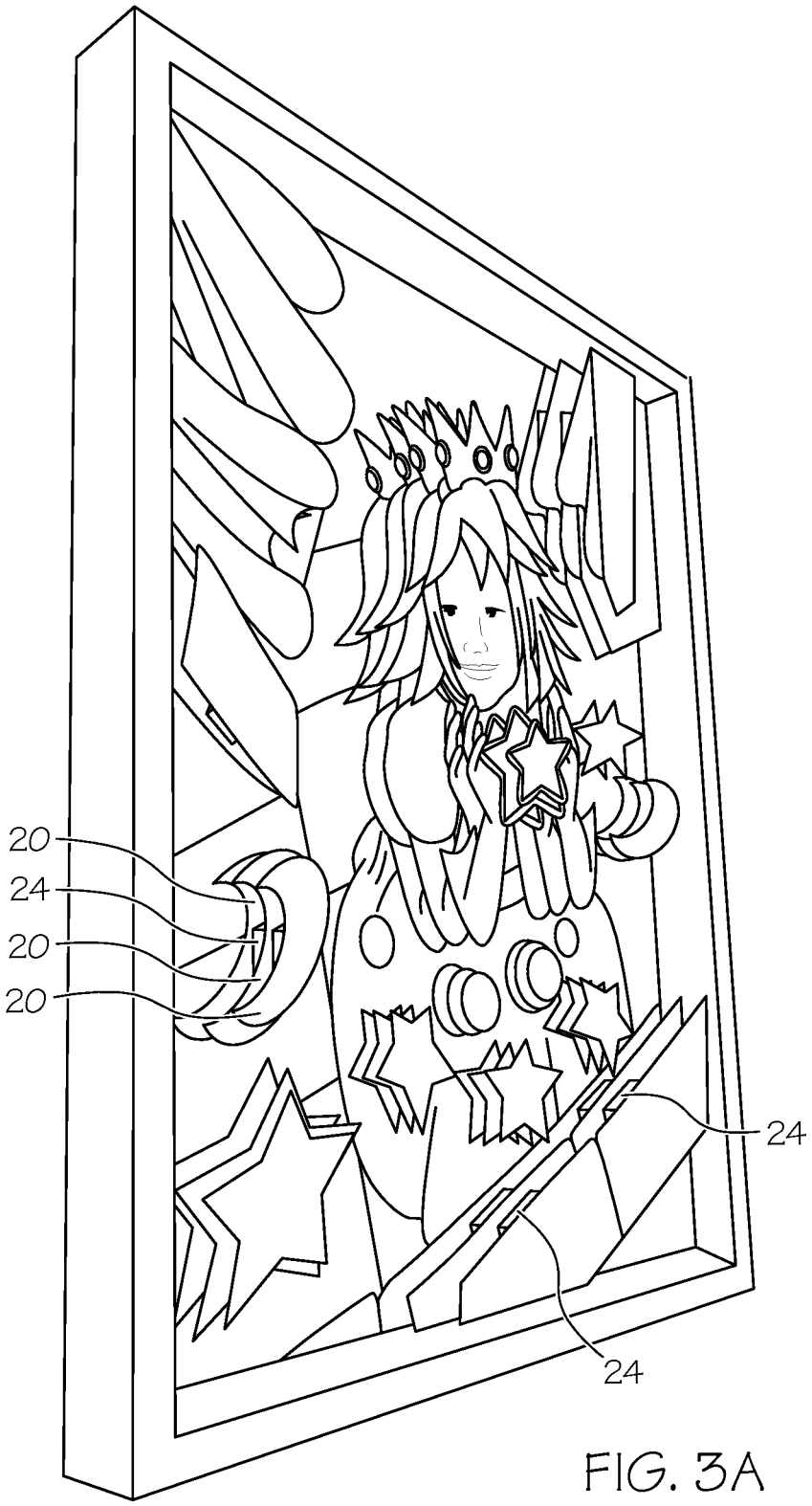
FIGS. 3A-3B are two perspective views of the three-dimensional artwork assembled from the artwork kit of FIG. 1.
Figure 3B:
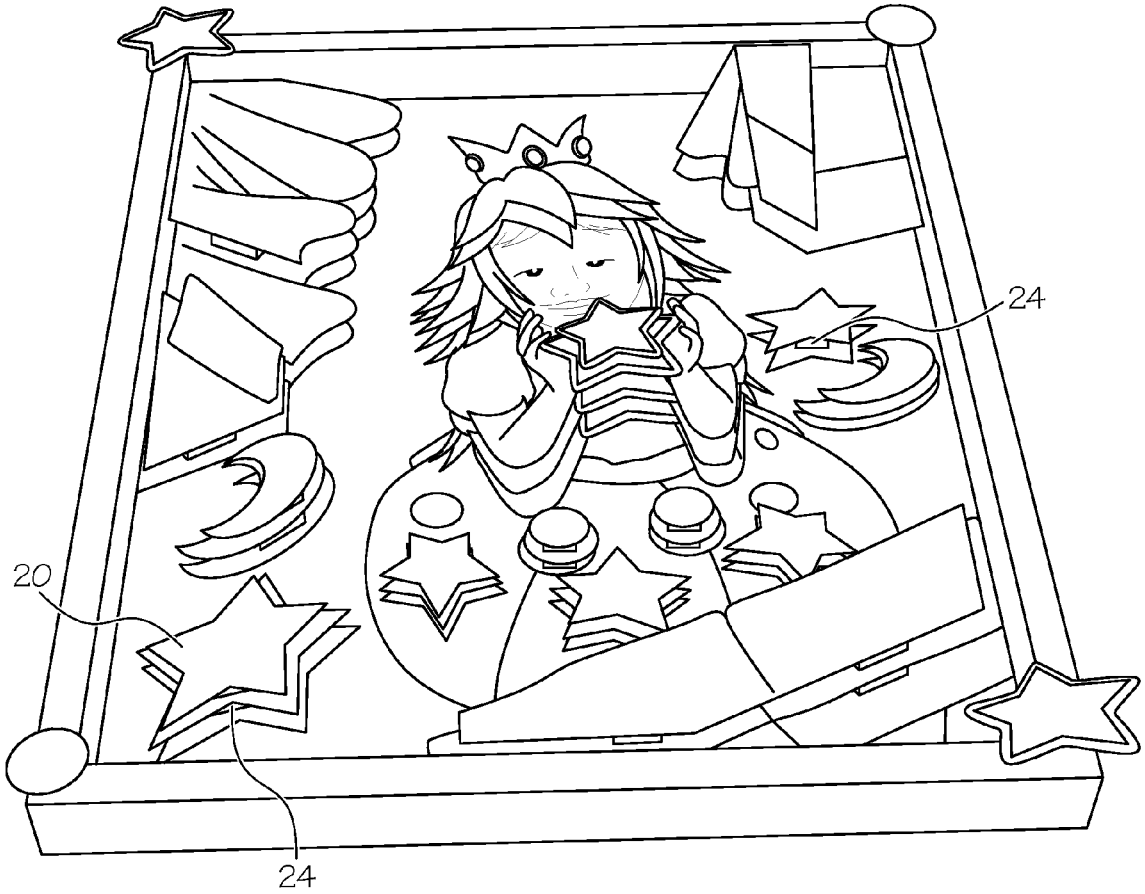

In one example, the sheet 30 and some of its detachable pieces 12 may include customizable space in a printed image that permits the user to upload and insert a photograph 44 selected by the user such as, for example, a human face as shown in FIGS. 3A-3B.

In an exemplary embodiment, the customizations 34 can be printed on customizable spaces located on the front surface 14 of each printable sheet 30, while the rear surface 16 of the printable sheet 30 can feature an adhesive and a non-stick backing mounted over the adhesive so as to be attached to and facing the rear surface. The non-stick backing can be a wax paper that may be peeled off to expose the adhesive on the rear surface of the printable sheet. Once the adhesive is exposed, the rear surface 16 of the printable sheet 30 may be affixed to the substrate 32. Adhesives used in this invention can be pressure-sensitive or remoistenable. The printable sheets 30 can be produced on a printing press or using desktop printer or other home or office printer.

In another exemplary embodiment, the artwork kit 10 can include at least three printable sheets 30. A single image can be printed on each of the at least three printable sheets 30. Each of the sheets 30 can be printed or imprinted on its front surface 14, on its rear surface 14, or on both the front and rear surfaces. As shown in FIG. 1, the front surface 14 of the first sheet 30 can be printed or imprinted, The artwork kit 10 can further include a plurality of separators 24, wherein each separator features a top surface and a bottom surface. The detachable pieces 12 can be separated from the at least three printable sheets 30 and configured so that each set 20 of three corresponding detachable pieces 12 featuring the same shape and image are attached together by affixing one of the plurality of separators 24 to a rear surface 16 of each corresponding detachable piece 12. For example, the detachable pieces 12 can be separated from the at least three printable sheets 30 to form three-piece sets 20 of each of the detachable pieces 12 that are identical in shape and color, wherein each three-piece set 20 includes a first detachable piece, a second detachable piece, and a third detachable piece.

The multiple sets 20 of detachable components 12 that are identically or similarly shaped can be attached to the substrate 32 in layer using a plurality of separators 24. The separators 24 can be manufactured from foam, plastic, wood, paper, or any other material suitable for being interconnected between a first layer of detachable pieces 12 and the substrate 32 by an adhesive and for interconnecting between additional stacked layers of detachable pieces 12. The separators 24 can be manufactured in any size, shape, or thickness. The separators 24 can feature adhesive areas or they can be manually glued to the substrate 32 and to the detachable pieces 12.

The top surface of an at least first separator of the plurality of separators 24 can be affixed to a rear surface of each of the first set of detachable pieces. Similarly, the top surface of an at least second separator of the plurality of separators 24 can be affixed to a rear surface of each of the second set of detachable pieces. Likewise, the top surface of an at least third separator of the plurality of separators 24 can be affixed to a rear surface of each of the third set of detachable pieces. The bottom surface of the at least first separator of the plurality of separators 24 can be affixed to a front surface of each of the second set of detachable pieces so as to interconnect between the rear surface of each of the first set of detachable pieces and the front surface of each of the second set of detachable pieces. The bottom surface of the at least second separator of the plurality of separators 24 can be affixed to a front surface of each of the third set of detachable pieces so as to interconnect between the rear surface of each of the second set of detachable pieces and the front surface of each of the third set of detachable pieces. The bottom surface of the at least third separator of the plurality of separators 24 can be affixed to a front surface of the substrate 32 so as to interconnect between the rear surface of each of the third set of detachable pieces and the front surface of the substrate. The artwork 40 formed by the attachment of the plurality of sets 20 of first, second, and third detachable pieces 12 to the substrate 32 can form a three-dimensional artwork 40.

The front surface 14 (or "side 1") of each sheet 30 can include codes, which can be letters, numbers or symbols, printed thereon that can be used to provide instructions to the user concerning how to assemble the three-dimensional artwork 40, e.g., insofar as the arrangement and attachment of the detachable pieces 12 on and to the substrate 32. The rear surface 16 (or "side 2") can include corresponding codes printed thereon. Each surface of each sheet 30 can also include markings 22 indicating where the separators 24 are to be attached for building the layers that create the three-dimensional artwork 40.

Either both or one of the printable sheet 30 and substrate 32 may include a frame 38. The detachable pieces 12 can be detachable from the frame 38. In embodiments in which the printable sheet 30 does not include a frame 38, the detachable pieces 12 can be connected to and detachable from one another. The frame 38 can be blank or it may include colored, e.g., gray, areas to assist the user in identifying which portions to remove from around the detachable pieces 12. The frame 38 can also feature directions or symbols instructing the user as to the orientation of the surface and edge of the printable sheet 30 that must first be loaded into the printer for printing the user's customizations onto the printable sheet. After the printing of customizations 34 on one surface of the printable sheet 30 has been completed, the software or printer may notify or instruct the user to remove the printable sheet and to orient and insert it into the printer again for printing of the customizations, if any, selected by the user for the reverse surface of the printable sheet.

The frame 38 may be waste that can be discarded once the detachable pieces 12 have been removed and the artwork 40 has been assembled by the user. In another embodiment, an artwork frame 42 (as shown in FIG. 3A) may be created using the material of the frame 38 remaining after the detachable pieces 12 have been removed.

The artwork kit 10 can further include software for installation on a computer to enable the user to customize customizable spaces on the at least one printable sheet with user customizations 34. Alternatively, the artwork kit 10 may feature a website that can be accessed via a communications network, and the website may include software that permits the user to customize the customizable spaces of the at least one printable sheet with user customizations 34.

In an exemplary embodiment, each printable sheet 30 may include a form identification number not shown in the drawings) that uniquely identifies that sheet. For example, all printable sheets of an identical type (e.g., identical size, shape, material, structure, or layout and orientation of detachable components) can have the same form identification number printed on each sheet of that printable sheet set. In one embodiment, each printable sheet set can feature a separate and unique form identification number. For example, if a printable sheet set includes two sheets, e.g., a first sheet and a second sheet, among a plurality of identical printable sheets, all exemplars of the first sheet of the printable sheet set can have a first form identification number (i.e., the same first form identification number is printed on each first sheet) and all exemplars of the second sheet of the printable sheet set can have a second form identification number (i.e., the same second form identification number is printed on each second sheet). The form identification number can identify each type of printable sheet 30, its size, and the format or layout and size of the detachable pieces 12 included on each sheet of the printable form. Each type of printable sheet 30 can include a plurality or set of sheets or pages all of which are identical in size, shape, orientation, material, construction, and format or layout and shape and size of their detachable pieces 12. In another embodiment, the form identification number can identify each unique, individual printable sheet 30, its size, and the format or layout and size of the detachable pieces 12 included on each printable sheet. The form identification number can be printed on the frame, in embodiments of the printable form that include a frame, or on one or more of the detachable components.

The software, whether installed on a computer, e.g., the user's computer, or accessed through a website, can include a field in which the form identification number can be entered and submitted. Once submitted, the software can recognize the printable form on which the user intends to print. The software can optimize the printer's print settings such as, for example, paper size, margins, and location and orientation of customizable spaces on each printable sheet, based upon the user's input of the correct form identification number as printed on the sheet being printed on by the user. In this way, the printer can position or configure print heads or other printing mechanisms so that printing of the customizations selected by the user occurs within a perimeter or boundary of each detachable piece and in an appropriate field, position, orientation, and location on each detachable piece.

The website may feature audio and video instructions as well as text instructions to instruct the user how to create the artwork 40, how to create, print and assemble the printable sheet 30 and its detachable pieces 12 with the separators 24, or both.

Puzzle Kit

Figure 4:
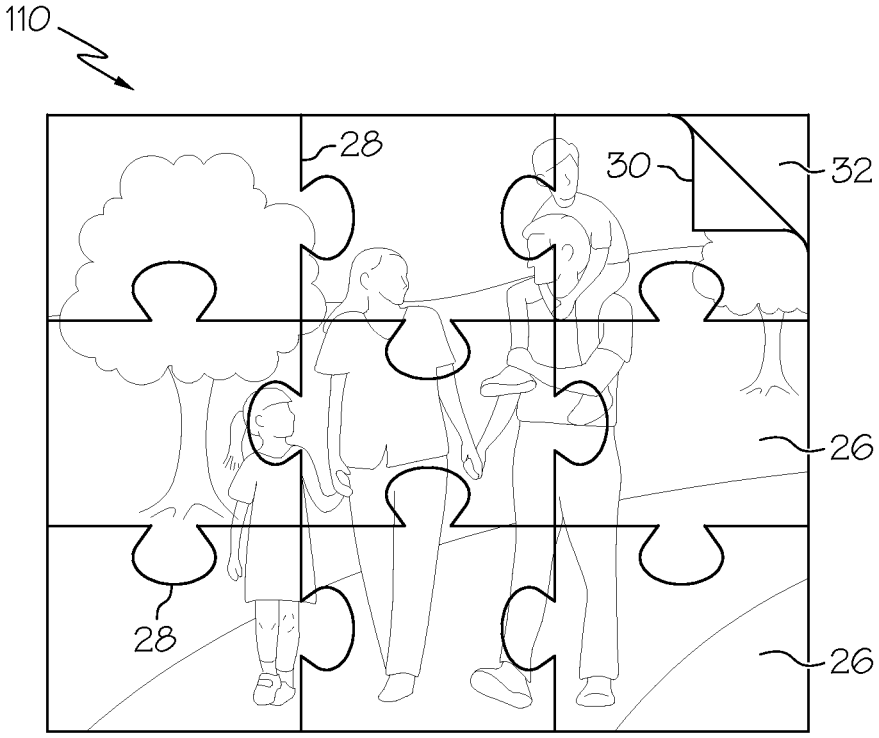
FIG. 4 is a front plan view of a printable form featuring detachable pieces that can be configured to form a jig-saw puzzle.
Figure 5:
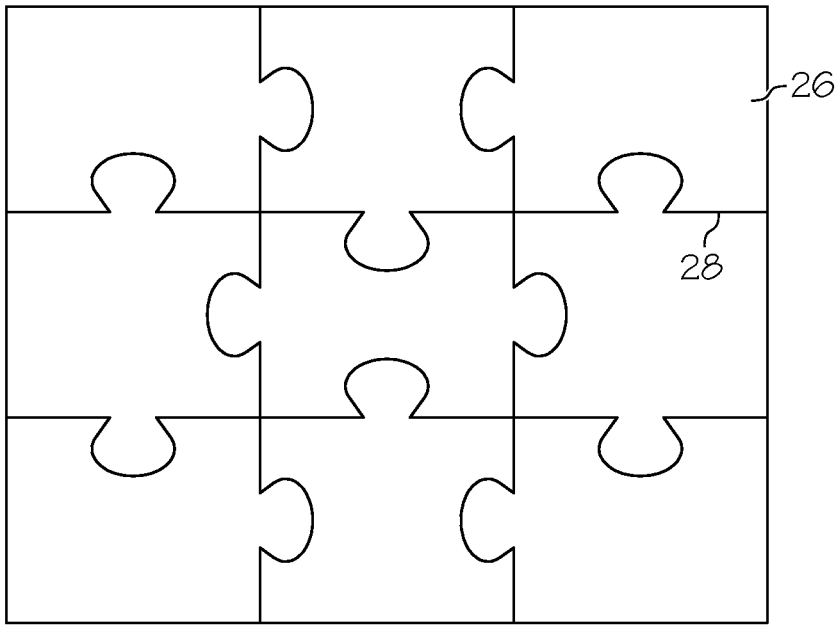
FIG. 5 is a front view of a substrate to which the printable form of FIG. 4 can be affixed.

The printable sheet 30 and the substrate 32 can each comprise matching lines of separation 28 so that, when the adhesive of the rear surface is exposed, the printable sheet 30 is attachable to the substrate 32 in a manner so that the lines of separation of the printable sheet 30 are aligned over and in parallel to the lines of separation of the substrate. In this way, as shown in FIGS. 4 and 5, the artwork kit can be used to create an artwork that is a jig-saw puzzle 110. Once the printable sheet 30 is attached to the substrate, a plurality of pieces 26 of the puzzle 110 can be disconnected from one another along the lines of separation 28 so that the puzzle pieces 26 can be randomized before putting the puzzle 110 together again.

Either both or one of the printable sheet 30 and substrate 32 may include a frame. The detachable pieces 26 can be detachable from the frame. In embodiments in which the printable sheet 30 does not include a frame, the detachable pieces 26 can be connected to and detachable from one another. The frame can be blank or it may include colored, e.g., gray, areas to assist the user in identifying which portions to remove from around the detachable pieces. The frame can also feature directions or symbols instructing the user as to the orientation of the surface and edge of the printable sheet that must first be loaded into the printer for printing the user's customizations onto the printable sheet 30. After the printing of customizations on one surface of the printable sheet 30 has been completed, the software or printer may notify or instruct the user to remove the printable sheet and to orient and insert it into the printer again for printing of the customizations, if any, selected by the user for the reverse surface of the printable sheet.

Model and Ornament Kit

In another embodiment, the sheet can include a plurality of fold lines, perforations, or cuts that permit the sheet to be folded and assembled into a predetermined object such as, for example, into the shape of a toy car or a Christmas tree ornament. In this way, a user can print or imprint colors, photographs, or other images on the sheet to customize the appearance of the object before the sheet is folded and assembled to create the object.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. An artwork kit comprising:

at least one printable sheet, the printable sheet comprising a plurality of detachable pieces, wherein the detachable pieces comprise customizable spaces on which user customizations may be printed by a user prior to detaching the detachable pieces from the printable sheet;

a substrate to which the detachable pieces are attachable to create an artwork; and a website that can be accessed via a communications network, the website comprising software that permits the user to customize the customizable spaces of the at least one printable sheet with user customizations.

2. The artwork kit of claim 1, wherein the substrate comprises a rigid backing.

3. The artwork kit of claim 1, wherein the detachable pieces comprise a front surface and a rear surface.

4. The artwork kit of claim 3, wherein the rear surface of the detachable pieces comprises an adhesive.

5. The artwork kit of claim 1, wherein the printable sheet comprises lines of separation from which the detachable pieces can be separated.

6. The artwork kit of claim 1, wherein the lines of separation comprise perforations.

7. The artwork kit of claim 1, wherein the customizations comprise at least one printed item selected from the group consisting of: text, an image, and a symbol.

8. The artwork kit of claim 1, wherein the printable sheet comprises a front surface on which the customizable spaces are located and a rear surface comprising an adhesive and a non-stick backing mounted over the adhesive so as to be attached to and facing the rear surface.

9. The artwork kit of claim 8, wherein the non-stick backing comprises wax paper.

10. The artwork kit of claim 8, wherein the non-stick backing is removable so as to expose the adhesive on the rear surface of the printable sheet.

11. The artwork kit of claim 10, wherein the printable sheet and the substrate each comprise matching lines of separation so that, when the adhesive of the rear surface is exposed, the printable sheet is attachable to the substrate in a manner so that the lines of separation of the printable sheet are aligned over and in parallel to the lines of separation of the substrate.

12. The artwork kit of claim 11, wherein the artwork formed by the attachment of the printable sheet to the substrate comprises a jig-saw puzzle.

13. The artwork kit of claim 12, wherein the substrate comprises a frame.

14. The artwork kit of claim 1, wherein the at least one printable sheet comprises at least three printable sheets.

15. The artwork kit of claim 14, wherein a single image can be printed on each of the at least three printable sheets.

16. The artwork kit of claim 15, wherein the artwork kit further comprises a plurality of separators, each separator comprising a top surface and a bottom surface.

17. The artwork kit of claim 16, wherein the detachable pieces can be separated from the at least three printable sheets and configured so that each set of three corresponding detachable pieces comprising the same shape and image are attached together by affixing one of the plurality of separators to a rear surface of each corresponding detachable piece.

18. The artwork kit of claim 16, wherein the detachable pieces can be separated from the at least three printable sheets to form three-piece sets of each of the detachable pieces that are identical in shape and color, wherein the three-piece sets comprise a first set of detachable pieces, a second set of detachable pieces, and a third set of detachable pieces.

19. The artwork kit of claim 16, wherein the top surface of an at least first separator of the plurality of separators is affixed to a rear surface of each of the first set of detachable pieces, the top surface of an at least second separator of the plurality of separators is affixed to a rear surface of each of the second set of detachable pieces, and the top surface of an at least third separator of the plurality of separators is affixed to a rear surface of each of the third set of detachable pieces.

20. The artwork kit of claim 19, wherein the bottom surface of the at least first separator of the plurality of separators is affixed to a front surface of each of the second set of detachable pieces so as to interconnect between the rear surface of each of the first set of detachable pieces and the front surface of each of the second set of detachable pieces, wherein the bottom surface of the at least second separator of the plurality of separators is affixed to a front surface of each of the third set of detachable pieces so as to interconnect between the rear surface of each of the second set of detachable pieces and the front surface of each of the third set of detachable pieces, and wherein the bottom surface of the at least third separator of the plurality of separators is affixed to a front surface of the substrate so as to interconnect between the rear surface of each of the third set of detachable pieces and the front surface of the substrate.

21. The artwork kit of claim 20, wherein the artwork formed by the attachment of the first, second, and third sets of detachable pieces to the substrate comprises a three-dimensional artwork.

22. The artwork kit of claim 21, wherein the substrate comprises a frame.

23. The artwork kit of claim 1, wherein the printable sheet is capable of having customizations printed in the customizable spaces by the user using a printer to create a user-customized sheet.

24. An artwork kit comprising:

at least one printable sheet, the printable sheet comprising a plurality of detachable pieces, wherein the detachable pieces comprise customizable spaces on which user customizations may be printed by a user prior to detaching the detachable pieces from the printable sheet;

a substrate to which the detachable pieces are attachable to create an artwork; and software for installation on a computer to enable the user to customize customizable spaces on the at least one printable sheet with user customizations.

* * * * *